United States Patent [19]

Collins

[11] Patent Number: 4,487,095

[45] Date of Patent: Dec. 11, 1984

[54] SQUEEZE TORQUE WRENCH

[75] Inventor: Bobby W. Collins, Kenner, La.

[73] Assignee: Power Tork Hydraulics, Inc., Baton Rouge, La.

[21] Appl. No.: 554,053

[22] Filed: Nov. 21, 1983

Related U.S. Application Data

[63] Continuation of Ser. No. 452,320, Dec. 27, 1982, abandoned, which is a continuation of Ser. No. 232,717, Feb. 9, 1981, abandoned.

[51] Int. Cl.[3] ..... B25B 13/46

[52] U.S. Cl. ..... 81/57.39; 81/57.21

[58] Field of Search ..... 81/57.39, 57.21

[56] References Cited

U.S. PATENT DOCUMENTS

| | | | |
|---|---|---|---|
| 2,615,682 | 10/1952 | Stone | 81/57.21 |
| 4,308,767 | 1/1982 | Wilmeth | 81/57.39 |

FOREIGN PATENT DOCUMENTS

| | | | |
|---|---|---|---|
| 2749857 | 10/1979 | Fed. Rep. of Germany | 81/57.39 |
| 671630 | 9/1929 | France | 81/61 |
| 972449 | 10/1964 | United Kingdom | 81/57.39 |

*Primary Examiner*—James L. Jones, Jr.

*Attorney, Agent, or Firm*—William David Kiesel

[57] ABSTRACT

A gearless squeeze torque wrench for use with a power means is provided comprising a wrench case, a fixed gripping jaw rigidly attached to said wrench case, a floating gripping jaw freely movable inside of said wrench case and a power transfer means connecting said floating gripping jaw to said power means.

5 Claims, 3 Drawing Figures

SQUEEZE TORQUE WRENCH

RELATED APPLICATIONS

This is a continuation of U.S. patent application Ser. No. 06/452,320 filed Dec. 27, 1982, now abandoned, which is a continuation of U.S. patent application Ser. No. 232,717, now abandoned, entitled "Squeeze Torque Wrench", and filed Feb. 9, 1981 by the inventor herein, specific mention of which is made to obtain benefit of its earlier filing date.

BACKGROUND OF THE INVENTION

1. Field of the Invention

The present invention relates generally to hydraulic torque wrenches.

2. Prior Art

There has been an increasing development of torque wrenches, particularly hydraulic torque wrenches, to meet the ever rising need to service heavy industrial equipment wherein a high controllable torque is needed to loosen the large threaded bolts and nuts used in such equipment.

Examples of the present state of the art can be seen in the following U.S. patents:

| U.S. PAT. NO. | INVEN-TOR | ISSUED | TITLE |
|---|---|---|---|
| 3,745,858 | Biach | 07/17/73 | TORQUING DEVICE |
| 3,930,776 | Keller | 01/06/76 | HYDRAULIC WRENCH |
| 4,027,561 | Junkers | 06/07/77 | HYDRAULIC WRENCH |
| 4,060,137 | Bickford, et al | 11/29/77 | TORQUE WRENCH |
| 4,308,767 | Wilmeth | 01/05/82 | STUD WRENCH |
| 2,615,682 | Stone | 10/28/52 | PIPE TONG |

and the following foreign patents:

| PATENT NUMBER | INVENTOR | ISSUED |
|---|---|---|
| German 2,749,857 | Wagner | 10/05/79 |
| Great Britain 972,449 | Sexton | 10/14/64 publication date |

These prior art wrenches generally use a relatively complex system of gears, bushings, drive pawls, pins, etc., which require the wrench to be relatively large and heavy in physical size and weight and which further gives rise to equipment failure through more and varied sources.

Additionally, because the clamping power of these fittings does not increase as the torque applied to the nut or bolt increases, rounding of the corners of the nuts and bolts occurs which makes the applicability of the fittings less effective.

SUMMARY OF THE INVENTION

Therefore, one object of this invention is to provide a torque wrench that is easier to use and more readily adaptable given its smaller size and lighter weight.

Another object of this invention is to provide a torque wrench which is relatively maintenance free given the lack of gearing and paucity of moving parts.

Another object of this invention is to provide a torque wrench which reduces rounding of nuts and bolts in field applications.

Still another object of this invention is to provide a torque wrench which can be effectively applied to rounded nuts and bolts encountered in field situations.

Other objects and advantages of this invention shall become apparent from the ensuing descriptions of the invention.

Accordingly, a gearless squeeze torque wrench is provided comprising a wrench case to which is rigidly attached at its outer end a fixed gripping jaw; a floating gripping jaw which moves inside of said wrench case and which is pivotally attached to a power transfer means; a power transfer means which swivels inside of the wrench case and is pivotally attached to both the wrench case itself and the floating gripping jaw, as well as being pivotally attached to a power means.

PREFERRED EMBODIMENTS OF THE INVENTION

Without limiting the scope of this invention, the preferred features of this invention will be described using a particular preferred embodiment of the invention.

Figure 1:
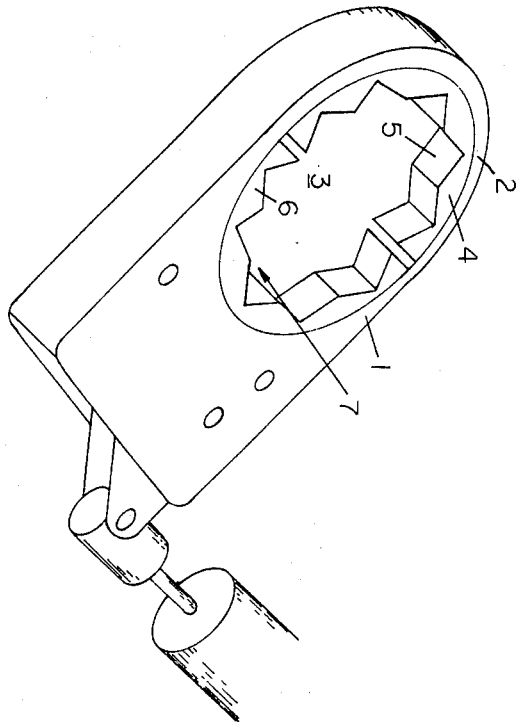
FIG. 1 is a side perspective view of the gearless squeeze torque wrench.

Referring to FIG. 1, wrench case 1 is a hollow shell rounded at outer end 2 with nut insert opening 3, which traverses the entire depth of case 1. Fixed gripping jaw 4 is rigidly attached to wrench case 1 with fixed gripping jaw teeth 5 forming the outer border of nut insert opening 3. Floating gripping jaw 6 moves freely inside wrench case 1 with floating gripping jaw teeth 7 forming the inner border of nut insert opening 3. In a preferred feature, there are six jaw teeth of equal size and dimension on jaw 4 and jaw 6.

Figure 2:
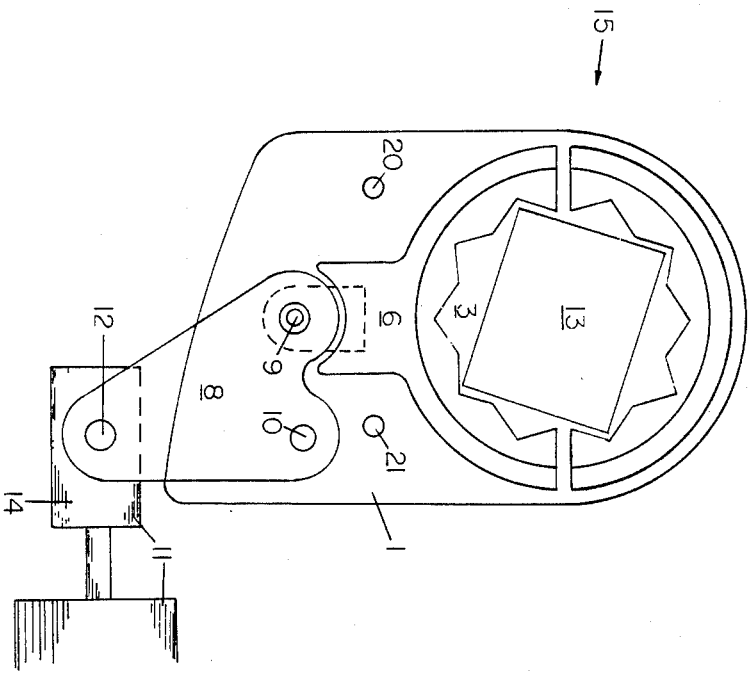
FIG. 2 is a overhead cutaway view of a preferred embodiment of the gearless squeeze torque wrench.

Referring to FIG. 2, floating gripping jaw 6 is rotatively attached to power transfer means 8 by swivel pin 9. Power transfer means 8 is pivotally attached to wrench case 1 by pivot pin 10 and is pivotally attached to power means 11 by swivel pin 12.

Therefore, as shown in the figures, power transfer means 8 is provided with three pivot points, allowing simultaneous torque and squeezing force to be applied to nut 13. A first pivot point is located coincidently with pivot pin 10. The same is true for second and third pivot points located coincidently with swivel pins 9 and 12, respectively. In this particular preferred embodiment, power means 11 is a hydraulic cylinder drive commonly in use in the art. Thus, when nut insert opening 3 is fitted around nut 13 and power piston 14 is extended; power transfer means 8 pivots on pivot pin 10 and closes floating gripping jaw 6 with ever increasing pressure around nut 13. As piston 14 continues to extend, the entire assembly (generally denoted as 15) rotates around nut 13, thus causing nut 13 to turn.

Figure 3:
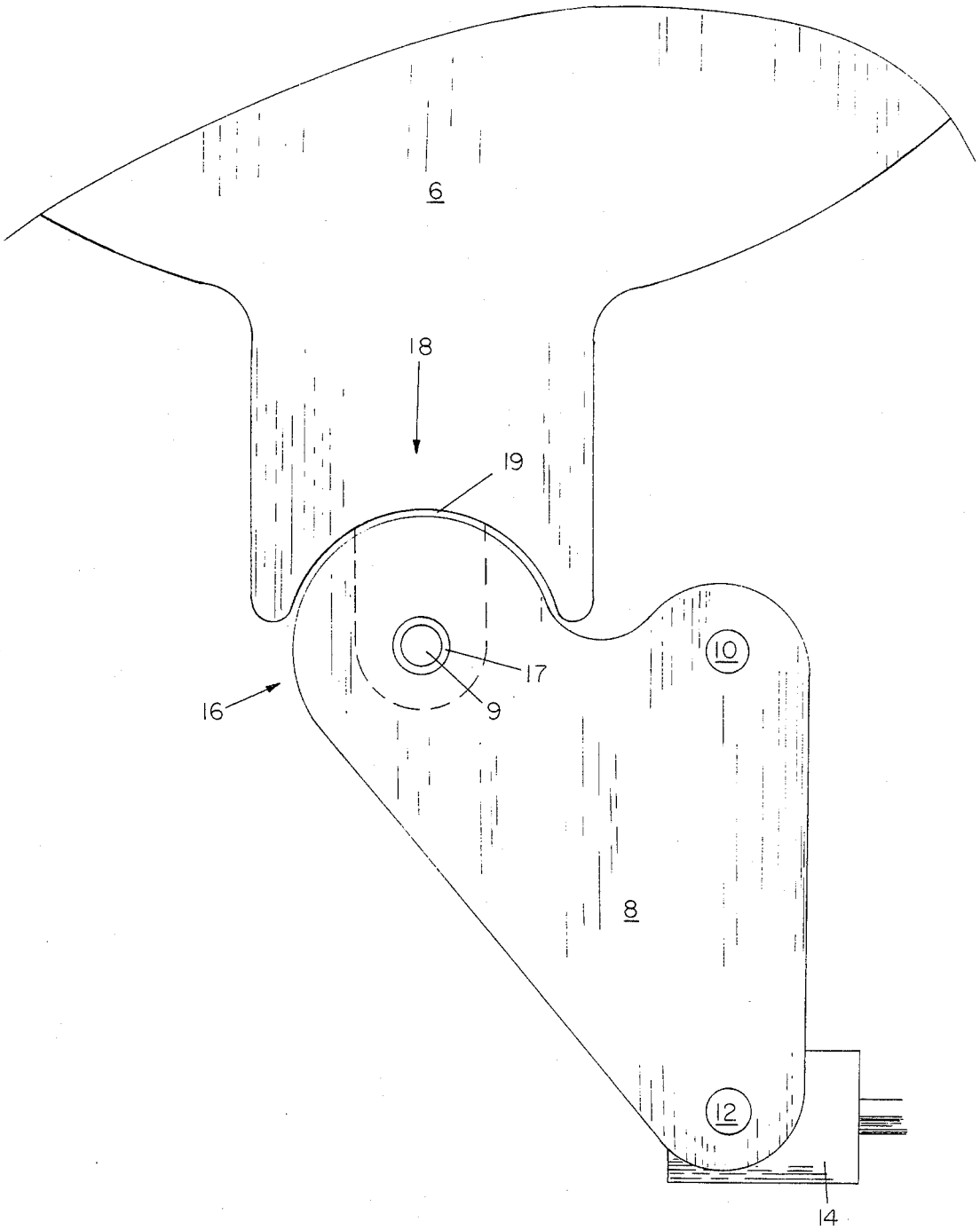
FIG. 3 is an expanded view of a preferred feature of the gearless squeeze torque wrench.

FIG. 3 describes a preferred feature wherein corner 16 of power transfer means 8 is circularly shaped and swivel pin 9 traverses center hole 17 of corner 16. Additionally, the power receiving end 18 of floating gripping jaw 6 is concavely shaped to allow pivotal mating with corner 16 in a circular pattern under increased loads.

Still referring to FIG. 3, an additional preferred feature is described wherein center hole 17 of corner 16 is oversized relative to swivel pin 9 which is rigidly attached to tongue 19, thus allowing swivel pin 9, tongue 19 and floating gripping jaw 6 to move freely and seek the best grip as it sets around nut 13.

Referring now back to FIG. 2, stop pins 20 and 21 are set in wrench case 1 to prevent floating gripping jaw 6 from retracting further than needed to clear nut 13 from jaws 4 and 6 when power piston 14 is retracted.

There are, of course, many obvious alternate embodiments and modifications to this invention; such as utilizing parallel plates attached to one another to serve as the casing, which are intended to be included within the scope of this invention as defined by the following claims.

What I claim is:

1. A gearless squeeze torque wrench for use with power means comprising:

(a) a hollow wrench case with a nut insert opening traversing the depth of the case and bordered on one end by a fixed gripping jaw fixed to said case;

(b) a floating gripping jaw having multiple teeth which slides in said wrench case having its jaw forming the opposite border of the nut insert opening from the fixed gripping jaw; and (c) a power transfer means pivotally attached inside said wrench case at a first pivot point, said power transfer means being pivotally attached to said floating gripping jaw at a second pivot point and further pivotally attached to said power means at a third pivot point, wherein the alignment of said first pivot point and said third pivot point is generally perpendicular to the alignment of said first pivot point and said second pivot point.

2. A gearless squeeze torque wrench, according to claim 1, wherein a corner of sad power transfer means is circularly rounded and the continguous end of said floating gripping jaw is similarly rounded.

3. A gearless squeeze torque wrench, according to claim 2, wherein said floating gripping jaw is provided with a pin, and wherein said power transfer means is provided with an oversized hole to receive said pin at said second pivot point.

4. A gearless squeeze torque wrench, according to claim 3, wherein each gripping jaw has six teeth of the same configuration.

5. A gearless squeeze torque wrench, according to claim 4, wherein a hydraulic cylinder drive is the power means.

* * * * *